US006437505B1

(12) United States Patent
Baret et al.

(10) Patent No.: US 6,437,505 B1
(45) Date of Patent: Aug. 20, 2002

(54) COPLANAR-TYPE PLASMA PANEL WITH IMPROVED MATRIX STRUCTURE ARRANGEMENT

(75) Inventors: Guy Baret, Grenoble; Pierre Paul Jobert, Nicolas de Macherin; Yvan Raverdy, Bernin, all of (FR)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/451,213

(22) Filed: Nov. 29, 1999

(30) Foreign Application Priority Data

Nov. 30, 1998 (FR) ..... 98 15058

(51) Int. Cl.[7] ..... H01J 17/49
(52) U.S. Cl. ..... 313/582; 313/292
(58) Field of Search ..... 313/582, 292

(56) References Cited

U.S. PATENT DOCUMENTS 4,206,386 A 6/1980 Akutsu et al. ..... 315/169.4

FOREIGN PATENT DOCUMENTS

JP 62 022352 1/1987 ..... H01J/11/00
JP 62 044931 2/1987 ..... H01J/17/49
JP 08 096714 4/1996 ..... H01J/11/00

OTHER PUBLICATIONS

Patent Abstracts of Japan, vol. 96, No. 8, Aug. 30, 1996. (NEC Corp.).
Patent Abstracts of Japan, vol. 011, No. 195 (E–518) Jun. 23, 1987 (Fujitsu Ltd.).
Patent Abstracts of Japan, vol. 011, No. 227 (E–526) Jul. 23, 1987 (Canon Inc.).
French Search Report dated: Aug. 4, 1999.

*Primary Examiner*—Vip Patel
(74) *Attorney, Agent, or Firm*—Joseph S. Tripoli; Dennis H. Irlbeck; Carlos M. Herrera

(57) ABSTRACT

The present invention relates to a plasma panel comprising a first tile called the rear tile and a second tile called the front tile, the two tiles being joined together with a distance of separation defining a space filled with gas, a first array of electrodes which is formed from a set of two parallel electrodes, called the sustaining electrodes, and which is placed on one of the tiles, a second array of electrodes called the addressing electrodes which is placed on the other tile, and an array of barriers which is placed on one of the tiles parallel to the array of addressing electrodes. According to the invention, the array of barriers is positioned on the tile carrying the first array of electrodes, the barriers having a height of less than the distance of separation between the two tiles and the separation between the two tiles is obtained by specific spacing means.

22 Claims, 2 Drawing Sheets

COPLANAR-TYPE PLASMA PANEL WITH IMPROVED MATRIX STRUCTURE ARRANGEMENT

FIELD OF THE INVENTION

The present invention relates to plasma panels more particularly plasma panels of the coplanar type.

Plasma panels (called PDP) are image display screens of the flat-screen type. There are two broad groups of PDP, namely PDPs whose function is of the DC type and those whose function is of the AC type. All these PDPs operate on the principle of a gas discharge accompanied by light emission. They generally comprise two insulating tiles each carrying one or more arrays of electrodes and defining between them a space filled with gas. The tiles are joined together so that the arrays of electrodes are orthogonal. Each electrode intersection defines a cell to which a gas space corresponds.

Among plasma panels of the AC operation type, two panel structures are currently used, namely so-called matrix structures, in which the sustaining discharges and the addressing discharges take place between an array of electrodes on the front substrate and an array of electrodes on the rear substrate, and so-called coplanar structures, in which the sustaining discharges are produced between two parallel arrays of electrodes deposited on the front substrate and the addressing discharges take place between one of the arrays of electrodes on the front substrate and the array of electrodes on the rear substrate.

The present invention relates more particularly to the latter type of structure.

More specifically and as shown in FIG. 1, coplanar-type plasma panels currently manufactured firstly comprise a rear substrate 1 consisting of a glass tile. In the embodiment shown, an addressing or column array of electrodes 2 is produced on this glass tile. This array of electrodes 2 is possibly covered with a dielectric layer 3, this layer being necessary for AC operation. Next, barriers 4 are deposited on this layer 3, these barriers being described in greater detail below. The plasma panel shown in FIG. 1 also includes a front element consisting of a front tile 5 made of glass. An array of two parallel electrodes 6 and 6', forming the sustaining electrodes, has been deposited on this tile. In order for the display to have good viewing characteristics, these electrodes are made of a transparent material such as indium tin oxide, called ITO. However, since the transparent materials used for the sustaining electrodes 6, 6' have a low conductivity, an electrode-bus 7, 7', made of a metallic material such as aluminium or silver, or a chromium-copper-chromium coating is also deposited on each of these electrodes 6 or 6'. As shown in FIG. 1, a dielectric layer 8, usually made of a lead borosilicate glass frit, is deposited on the sustaining electrodes 6, 6'. This layer 8 is covered with a protective layer 9, generally made of magnesium oxide (MgO). In this type of panel, the barriers 4 are always of the "supporting" type, that is to say their height h corresponds to the distance separating the rear element from the front element of the panel. These barriers have the shape of walls with a width l of between 40 and 100 $\mu$m and their height h is between 120 and 200 $\mu$m. Since these barriers are of the "supporting" type, they must be uniform in height—their height cannot vary by more than at most +/−3%. This is because too great a height variation $\Delta h$ means that there is a space $\Delta h$ between the top of a barrier and the front substrate. This space may be sufficient to allow extension of the discharge from one cell into its neighbour by charge transfer. This phenomenon is detrimental to the operation of the panel. Indeed, the existence of a channel formed by this space allows charge diffusion between adjacent cells, one of which may be ignited while the other is extinguished. This charge diffusion then causes unintentional ignition of the so-called extinguished cell. Moreover, the barriers are always deposited on the rear substrate 1 because the sustaining discharges are produced at the surface of the front substrate. Now, these barriers define a cup, an arrangement which allows the phosphors Ip to be received, and these phosphors must not be in contact with the discharge in order to prevent their degradation.

SUMMARY OF THE INVENTION

The object of the present invention is to propose a novel plasma panel structure of the coplanar type, allowing the various drawbacks mentioned above to be overcome.

The subject of the present invention is therefore a plasma panel comprising a first tile called the rear tile and a second tile called the front tile, the two tiles being joined together with a distance of separation defining a space filled with gas, a first array of electrodes which is formed from a set of two parallel electrodes, called the sustaining electrodes, which are positioned on one of the tiles, a second array of electrodes, called the addressing electrodes, which are placed on the other tile perpendicular to the first array, and an array of barriers which is placed on one of the tiles parallel to the array of addressing electrodes, characterized in that the array of barriers is positioned on the tile carrying the first array of electrodes.

According to another characteristic of the present invention, the barriers have a height of less than the distance of separation between the two tiles, the separation between the two tiles being obtained by specific spacing means.

However, the present invention may also apply to panels having full-height barriers.

According to a preferred embodiment, the array of barriers is placed on the rear tile and the height of the barriers is between 60 and 80% of the distance of separation between the tiles.

According to another characteristic of the present invention, a first array of phosphors is deposited on the front tile and a second array of phosphors is deposited on the rear tile in regions not subjected to discharges. The purpose of this second array of phosphors is to increase the area covered by phosphors and therefore the light output of the panel. The second array of phosphors is preferably deposited on the side wall of the barriers.

In this case and according to an additional characteristic of the present invention, the spacing means consists of balls or studs, the balls or studs being positioned either on the front tile or on the rear tile.

The present invention also relates to a rear element for a plasma panel characterized in that it comprises:

- a tile;
- a first array of sustaining electrodes which is deposited on the tile;
- a layer of a so-called thick dielectric material;
- a layer for protection against ion bombardment due to the discharge;
- an array of barriers.

According to a preferred embodiment, the array of sustaining electrodes is produced by photoetching thin metal layers or by screen printing a conductive paste, such as a silver paste. In addition, the dielectric layer consists of a paste containing a glass frit such as a lead borosilicate and the protective layer consists of a layer of magnesia.

According to another characteristic of the present invention, the rear element also includes an array of phosphors which is deposited in the regions not subjected to discharges.

The present invention also relates to a front element for a plasma panel, characterized in that it comprises:

a tile;

an array of addressing electrodes;

a layer of an insulating material; and an array of phosphors.

According to a preferred embodiment, the array of addressing electrodes is produced by photoetching a transparent conductive layer, and the insulating material consists of a glass frit, such as a lead borosilicate, or of silica, alumina or magnesium oxide deposited as thin films. Moreover, the front element includes, between the array of addressing electrodes and the layer of insulating material, a black matrix deposited in the low-emissivity regions of the surface in order to reduce the diffuse reflection coefficient of the panel.

BRIEF DESCRIPTION OF THE DRAWINGS

Further characteristics and advantages of the present invention will appear on reading the description given below of a preferred embodiment, this description being made with reference to the drawings appended hereto, in which.

DESCRIPTION OF A PREFERRED EMBODIMENT

An embodiment of a plasma panel according to the present invention will now be described with reference to FIGS. 2 and 3. In these figures, in order to simplify the description, the same elements bear the same references.

Figure 2:
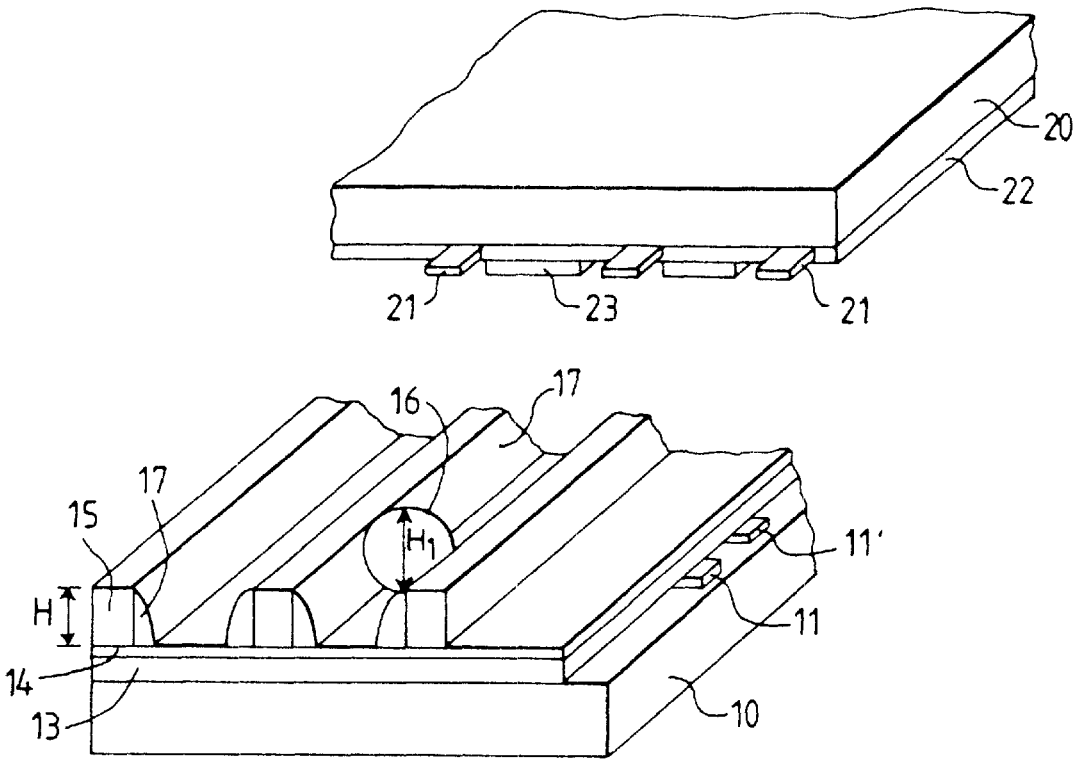
FIG. 2 is a schematic perspective view of an embodiment of a plasma panel according to the present invention.

FIG. 2 shows, in schematic perspective, a small part of a rear element of a plasma panel according to the present invention. As shown in FIG. 2, the rear element therefore comprises a rear tile 10, more particularly a glass tile, on which an array of a set of two sustaining electrodes 11, 11' has been deposited. These electrodes, the resistivity of which must not be too high, namely 100 Ω for one electrode, are produced either by photoetching thin metal layers or by direct deposition, such as the screen printing of a silver paste. The array of sustaining electrodes is covered with a layer 13 of a so-called thick dielectric material. This layer is generally obtained by deposition, using screen printing, of a paste containing a glass frit such as a lead borosilicate. Once deposited, the assembly is fired at a temperature of between 520 and 590° C. Typically, the assembly is fired at 570° C. for half an hour. At the end, a dielectric layer having a thickness of approximately 20 to 30 μm is obtained. In order to increase the reflection coefficient of the rear substrate, a white pigment may be added in a known manner to the dielectric. Deposited on this layer 13 is a layer for protection against the ion bombardment due to the discharge. This protective layer is preferably a layer of magnesia or MgO deposited with a thickness of 0.5 to 1 μm approximately, by gun evaporation. This layer of magnesia also makes it possible to lower the operating voltages of the device.

According to the present invention and as shown in FIG. 2, an array of barriers 15 is produced on the protective layer. These barriers may be produced using various known techniques, for example by photolithography, screen printing or peening. They are made of a material such as a composition of the lead borosilicate type to which a mineral filler, of silica or alumina, may or may not be added. FIG. 2 shows an array of barriers 15 called non-supporting barriers, that is to say barriers having a height H of less than the distance separating the two tiles. However, the present invention may also apply to a panel provided, in a conventional manner with full-height or "supporting" barriers.

Figure 3:
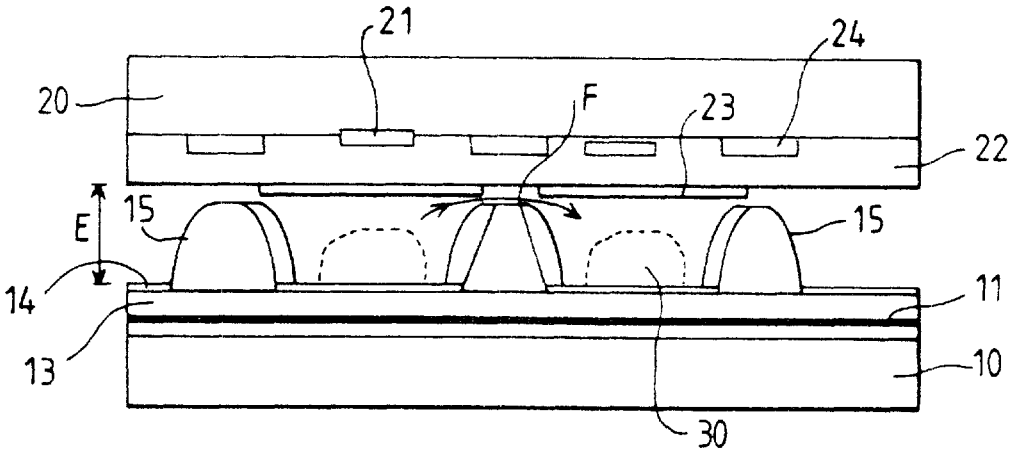
FIG. 3 is a cross-sectional view of a plasma panel of the type shown in FIG. 2.

According to one embodiment of the present invention, the height of the non-supporting barriers is between 60 and 80% of the distance of separation E, as shown in FIG. 3, which separates the two, front and rear, elements of the plasma panel when the latter is completed. More specifically, the height H of the barriers varies between 30 μm for high-resolution panels and 150 μm for panels used especially in television. FIGS. 2 and 3 show rectangular barriers. In fact, the shape of the barriers, in terms of area and of profile, is adapted to the arrangement of the cells.

According to the present invention, the rear element may receive an array of phosphors 17 consisting in a known manner of green, red and blue phosphors allowing a colour plasma panel to be produced. In order to prevent their deterioration, these phosphors are deposited only on the regions not subjected to the discharge and more particularly on the side wall of the barriers, as is shown in FIGS. 2 and 3. Moreover, FIG. 2 shows a spacing means 16 consisting of a ball. This spacing means 16 is deposited in separate regions of the cells and has a height H1 corresponding to the distance of separation E in FIG. 3.

Figure 1:
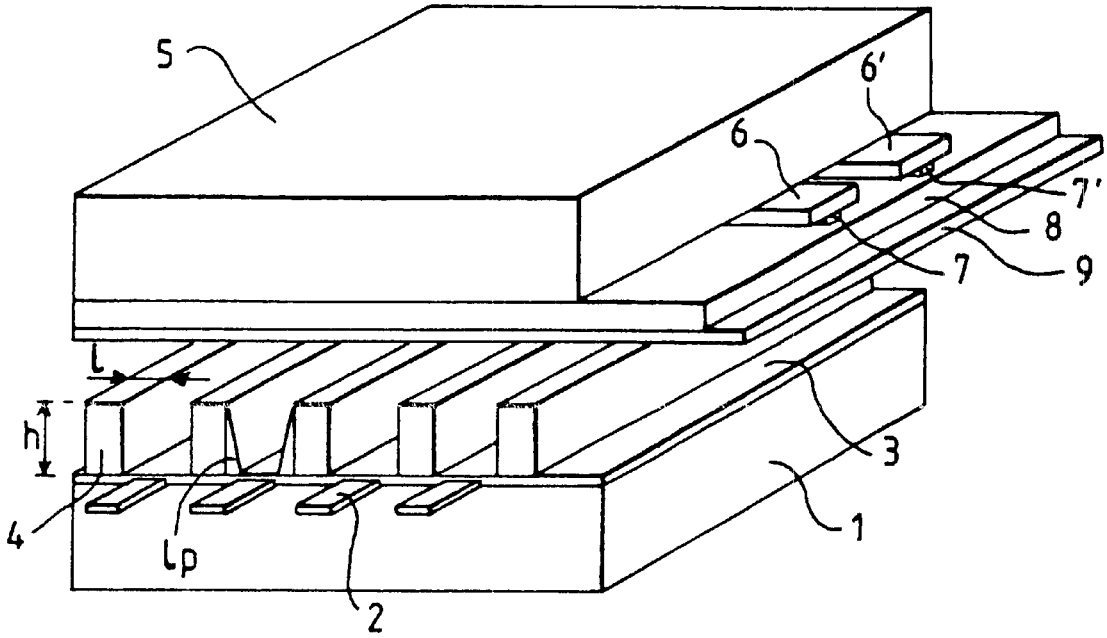
FIG.1 PRIOR ART
FIG. 1, already described, is a schematic perspective view of a coplanar-type plasma panel according to the prior art.

One embodiment of the front element of the plasma panel will now be described. This front element consists of a front tile 20 made more particularly of glass. An array of addressing electrodes 21 has been deposited on this front tile 20. These addressing electrodes are produced, for example, by photoetching a transparent conductive layer, such as one made of ITO. This is because these electrodes require only quite a low conductivity. However, if the transparent material has a very low conductivity, especially when this material consists of tin oxide, the array of addressing electrodes may be covered with a metal bus, not shown. This bus is deposited as in the embodiment in FIG. 1.

As shown in FIG. 3, a black matrix 24 may be placed in the low-emissivity regions of the surface. This black matrix is intended to reduce the diffuse reflection coefficient of the panel. Moreover, according to an additional variant, colour filters may also be used to reduce the diffuse reflection coefficient of the panel. As shown in FIGS. 2 and 3, a layer 22 of an insulating material is deposited on the array of addressing electrodes 21. This layer of insulating material may be made either of a glass frit, such as a lead borosilicate, or of silica, alumina or magnesium oxide. In the case of a glass frit, it is necessary to fire the layer, which then has a thickness of 10 to 30 μm. When silica, aluminia or magnesium oxide are used, this material is deposited as thin films, which does not require firing. In a known manner, an array of phosphors 23 is deposited above the addressing electrodes 21 in the part facing the cups produced between the barriers 15, the deposited coatings being produced in such a way that the G, R and B colours of the phosphors are in mutual correspondence.

FIG. 2 shows a panel in which the spacing device formed by the balls 16 is deposited on the rear element. However, the balls could also be deposited on the front element between the dielectric layer and the phosphors. Moreover, in a known manner, a seal is used to close the panel in a gastight manner. This seal may be deposited equally well on the front element or the rear element of the plasma panel.

As shown more specifically in FIG. 3, with this so-called "non-supporting" structure, there is a space between the top of the barriers 15 and the front element. This space has a size of a few tens of microns and allows the panel to be easily pumped when creating a vacuum in it, since the structure is relatively open. Moreover, a cell conditioning effect is observed without propagation of the discharge along the lines. Thus, with this structure, there is a certain transfer, from one cell to another, of charges (ions or electrons of the plasma) and of ultraviolet radiation which are able to assist the striking of a discharge in the gas. This phenomenon is shown by the arrow f in FIG. 3. However, in the proposed structure, extension of the discharges along the sustaining electrodes is blocked by the barriers since the latter are actually deposited on the face supporting the sustaining electrodes. The space between the barriers and the opposite substrate is close to the array of addressing electrodes, in which region the volume density of charges during a discharge is very low. There is therefore no possible extension of the discharge and the risks of unintentional ignition of a so-called extinguished cell are eliminated. In addition, in this structure, the height of the barriers 15 is no longer a critical value and a uniformity of between 5 and 10% is acceptable. The addressing electrodes may be easily made of a transparent conductor such as ITO and generally do not require a metal bus since the addressing electrodes need to have a low conductivity with respect to the sustaining electrodes. With this type of plasma panel, it is also possible to use thin-film dielectric layers to protect the addressing electrodes from the ion bombardment. The use of thin films requires no high-temperature firing, namely at temperatures above 480° C. Consequently, the tile is not subjected to any compaction or deformation phenomenon.

It is obvious to those skilled in the art that the structure in FIGS. 2 and 3 was given by way of example and that it can be modified without departing from the scope of the claims hereinbelow. As already mentioned, the invention also applies especially to full-height barriers deposited on the rear tile, the phosphors being placed on both tiles.

In addition, the spacing means may be formed by studs or other means produced by screen printing, photolithography or an equivalent process.

The present invention may therefore apply to various types of structure for coplanar-type plasma panels.

What is claim is:

1. A plasma panel comprising a first tile and a second tile, said two tiles being joined together with a distance of separation defining a space filled with gas, a first array of electrodes formed from a set of two parallel sustaining electrodes placed on one of the first or second tiles, a second array of addressing electrodes placed on the other tile perpendicular to the first array of electrodes, and an array of barriers positioned on the tile carrying the first array of sustaining electrodes and parallel to the array of addressing electrodes.

2. Plasma panel according to claim 1, wherein the array of barriers is placed on the rear tile.

3. Plasma panel according to claim 1, wherein the barriers have a height of less than the distance of separation between the two tiles, the separation between the two tiles being obtained by specific spacing means.

4. Plasma panel according to claim 3, wherein the height of the barriers is between 60 and 80% of the distance of separation between the tiles.

5. Plasma panel according to claim 1, wherein the barriers have a height equal to the distance of separation between the two tiles.

6. Plasma panel according to claim 1, wherein a first array of phosphors is deposited on the front tile.

7. Plasma panel according to claim 1, wherein a second array of phosphors is deposited on the rear tile in regions not subjected to discharge.

8. Plasma panel according to claim 7, wherein the second array of phosphors is deposited on the side wall of the barriers.

9. Plasma panel according to claim 3, wherein the spacing means consists of balls or studs.

10. Plasma panel according to claim 9, wherein the balls or studs are positioned on the front tile.

11. Plasma panel according to claim 9, characterized in that the balls or studs are positioned on the rear tile.

12. Rear tile element for a plasma panel, comprising:

a tile;

a first array of sustaining electrodes which is deposited on the tile;

a layer of a so-called thick dielectric material overlying the sustaining electrodes;

a layer for protecting against ion bombardment due to the discharge overlying the dielectric material; and, an array of barriers on the ion protecting layer and perpendicular to the first array of sustaining electrodes.

13. Element according to claim 12, wherein the array of sustaining electrodes is produced by photoetching thin metal layers.

14. Element according to claim 12, wherein the array of sustaining electrodes is produced by screen printing a conductive paste, such as a silver paste.

15. Element according to claim 12 wherein the dielectric layer consists of a paste containing a glass frit such as a lead borosilicate.

16. Element according to claim 12, wherein the protective layer consists of a layer of magnesia.

17. Element according to claim 12, characterized in that it also includes an array of phosphors which is deposited in the regions not subjected to discharge.

18. Front element for a plasma panel, comprising:

a first tile and an opposed second tile;

an array of addressing electrodes carried by the second tile;

a layer of an insulating material overlying the addressing electrodes; and an array of phosphors carried by the first tile and arranged parallel to the array of addressing electrodes.

19. Element according to claim 18, characterized in that the array of addressing electrodes is produced by photoetching transparent conductive layers.

20. Element according to claim 18, characterized in that the insulating material consists of a glass frit, such as a lead borosilicate, or of silica, alumina or magnesium oxide deposited as thin films.

21. Element according to claim 18, characterized in that it includes, between the array of addressing electrodes and the layer of insulating material, a black matrix deposited in the low-emissivity regions of the surface.

22. Plasma panel according to claim 6, wherein the second array of phosphors is deposited on the side wall of the barriers and wherein the first array of phosphors is deposited parallel to the addressing electrodes.

* * * * *